US005927117A

United States Patent [19]

Zhang

[11] Patent Number: 5,927,117

[45] Date of Patent: Jul. 27, 1999

[54] METHODS TO MEASURE AND CONTROL STRIP SHAPE IN ROLLING

[75] Inventor: Jinzhi Zhang, Beijing, China

[73] Assignee: Central Iron & Steel Research Institute Ministry Metallurgical Industry, Beijing, China

[21] Appl. No.: 08/948,354

[22] Filed: Oct. 10, 1997

[30] Foreign Application Priority Data

Oct. 11, 1996 [CN] China ..... 96120029
Sep. 12, 1997 [CN] China ..... 97116431

[51] Int. Cl.[6] ..... B21B 37/28

[52] U.S. Cl. ..... 72/9.1; 72/9.2; 72/11.7; 72/11.8

[58] Field of Search ..... 72/7.6, 8.1, 8.3, 72/8.9, 9.1, 9.2, 11.1, 11.2, 11.6, 11.7, 11.8, 12.7

[56] References Cited

U.S. PATENT DOCUMENTS 4,715,209 12/1987 Oshima ..... 72/9.2
5,126,947 6/1992 Koyama ..... 72/11.7
5,493,885 2/1996 Nomura et al. ..... 72/9.1
5,495,735 3/1996 Nishimura ..... 72/11.8
5,651,281 7/1997 Seidel ..... 72/9.2

OTHER PUBLICATIONS

Hiromi Matsumoto, et al Comparison of Various Crown–Control Mills in Hot Rolling, Technical Development Bureau, Nippon Steel Corp. (NSC) Futtsu, Japan, Sheet and Coil Div., Nippon Corporation (NSC) Tokyo, Japan, pp. 158–165.

*Primary Examiner*—Joseph J. Hail, III
*Assistant Examiner*—Ed Tolan
*Attorney, Agent, or Firm*—Birch, Stewart, Kolasch & Birch, LLP

[57] ABSTRACT

A method to measure strip shape in rolling and a method of using the measuring method to control the same are provided in present invention, which can dramatically simplify the computation during the measurement of strip shape. On the basis of a prior mathematical model, the invention is realized by applying a strip rigidity coefficient q reflecting the features of a piece to be rolled, and a shape rigidity coefficient m reflecting those of a mill, to express heredity coefficient $\eta$.

9 Claims, No Drawings

METHODS TO MEASURE AND CONTROL STRIP SHAPE IN ROLLING

INTRODUCTION

The present invention relates to a method to measure and a method of using the measuring method to control strip shape in strip rolling.

BACKGROUND OF THE INVENTION

There are various types of strips, i.e. steel strip, copper strip and non-metal strip, and only steel strip is taken as an example in the following description. Generally speaking, the strip shape is expressed by section shape and flatness, while the section shape by strip crown. The strip crown is usually expressed by thickness difference between the thickness at the center of a strip and the thickness at the point 25 mm from the edge thereof, denoted by $C_H$ and $C_h$ in the present invention. The flatness is usually expressed by elongation difference along width direction, donated by $\Delta\epsilon$ in the present invention.

In recent years, customers are making more and more rigorous demands on the section shape and the flatness of a steel strip, meanwhile, manufacturers are expecting to produce strips with even smaller or fixed crown so as to improve yield. Therefore, how to realize free control of the strip crown and the flatness becomes the key issue in rolling techniques. In addition, the measurement, especially real time measurement is the first problem to be settled as to controlling the strip shape in strip rolling.

A mathematical model used for measuring strip shape was given in the paper "*Comparison of Various Crown-control Mills in Hot Rolling*" written by H. Matsumoto, K. Nakajima and T. Yanai for the 6th International Steel Rolling Conference held in Dusseldorf, Germany in June, 1994, $$C_{h_i} = (1-\eta_i)C_i + \eta_i \frac{h_i}{H_i} C^F_{H_i} \tag{1}$$

$$C^F_{H_i} = C_{h_{i-1}} - h_{i-1}\Delta\varepsilon_{i-1} \tag{2}$$

$$\Delta\varepsilon_i = \xi\left(\frac{C_{h_i}}{h_i} - \frac{C^F_{H_i}}{H_i}\right) \tag{3}$$

where $C_H$—entry crown;

$C_h$—exit crown;

$C^F_H$—vector entry crown;

C—mechanical strip crown indicating algebraic summation of original crown of rolls, and roll crowns due to rolling forces, rolling bending forces, unevenly-distributed temperature along rolls and erosion;

h—exit thickness;

H—entry thickness;

$\eta$—heredity coefficient expressed by the ratio of entry crown $C_H$ to exit crown $C_h$;

$$\eta = \frac{\partial C_h}{\partial C_H}\frac{H}{h};$$

$(1-\eta)$—imprinting ratio indicating the efficiency coefficient of the mechanical strip crown; $\xi$—shape disturbing coefficient reflecting the relation between change of crown ratio and the flatness; $\Delta\epsilon$—the strip flatness; i—pass No.

For a given mill and a strip of certain width, the strip crown and the flatness of any pass i can be obtained by using the entry thickness H, the exit thickness h, the heredity coefficient $\eta$ obtained by entering the exit thickness h and the strip width B against prior experimental plots, and the shape disturbing coefficient $\xi$ by entering $\gamma$ against prior experimental plots of this paper. $\gamma$ is obtained by computation of the exit thickness h, the strip width B and the roll diameter 2R.

However, in practice, it is rather difficult to obtain $\eta$ correctly, because $\eta$ is not only a quadratic function of strip width and thickness but also related to the parameters of both a piece to be rolled and a mill to be measured. For the same mill and a strip of certain specification, the heredity coefficient $\eta_i$ of each pass must be worked out so as to calculate the real time strip crown $C_{h_i}$ and the flatness $\Delta\epsilon_i$ by using equations (1) and (3). For instance, eight heredity coefficients $\eta_i$ have to be worked out for an 8-pass rolling mill, which will complicate the control of rolling and be much more costly.

Therefore, it is the object of the present invention to provide a method to measure strip shape and a method using the measuring method to control the same in the process of rolling, in which calculation can be dramatically simplified.

THE TECHNICAL SOLUTION OF THE INVENTION

On the basis of the prior mathematical model, the object of the present invention is realized by means of following technical solution.

A strip rigidity coefficient q reflecting the features of a piece to be rolled and a shape rigidity coefficient m reflecting features of a mill to be measured are used to express the heredity coefficient $\eta$. As the summation of the heredity coefficient $\eta$ and imprinting ratio $(1-\eta)$ equals 1, the following two equations are defined:

$$\frac{m}{m+q} = 1-\eta \tag{4}$$

$$\frac{q}{m+q} = \eta \tag{5}$$

Substituting (4) and (5) into (1), we have $$C_{h_i} = \frac{m}{q_i+m}C_i + \frac{q_i}{q_i+m}\cdot\frac{h_i}{H_i}C^F_{H_i} \tag{6}$$

Substituting (2) into (6) and (3) respectively, we have following two equations with respect to pass i.

$$C_{h_i} = \frac{q_i}{q_i+m}\cdot\frac{h_i}{H_i}C_{h_{i-1}} - \frac{q_i}{q_i+m}\cdot h_i\Delta\varepsilon_{i-1} + \frac{m}{q_i+m}C_i \tag{7}$$

$$\Delta\varepsilon_i = \xi\left[\frac{C_{h_i}}{h_i} - \frac{C_{h_{i-1}}}{h_{i-1}} + \Delta\varepsilon_{i-1}\right] \tag{8}$$

It is the equations (7) and (8) that are shape measuring model in strip rolling according to the present invention.

It shall be noted that the strip rigidity coefficient $q_i$ can be calculated according to the following equation using the measured rolling force $p_i$ of pass (or mill stand) i, the strip width B, the reduction $\Delta h_i$, the reduction rate $r_i$ and the roll radius R, $$q_i = \frac{P_i}{B\sqrt{\Delta h_i R_i^1} \cdot r_i} \tag{9}$$

where $r_i$—reduction rate, expressed as $$r_i = \frac{H_i - h_i}{H_i}$$

$P_i$—rolling force:

B—strip width;

$\Delta h_i$—reduction, expressed as $\Delta h_i = H_i - h_i$;

$R^1{}_i$—radius of roll flattening, expressed as $$R_i^1 = R\left(1 + \frac{2.14 \times 10^{-4} \cdot P_i}{B(H_i - h_i)}\right)$$

i—No. of a mill stand or a pass.

Heredity coefficient $\eta_i$ can be obtained through experiments in advance and the shape rigidity coefficient m is calculated using equation (10) derived from (4) or (5)

$$m = \frac{q_i(1 - \eta_i)}{\eta_i} \tag{10}$$

It is proven by experiments and calculations that m is a fixed parameter of a mill with the same rolling width. Namely, the shape rigidity coefficient m of each pass is the same for a given mill. It is due to this discovery made by the present inventor that the method to measure strip shape is thoroughly changed.

Furthermore, the heredity coefficient $\eta$ can also be worked out using the known strip shape theory.

The following is a detailed description of the shape measuring method according to the present invention using the above-mentioned mathematical model.

As mentioned above, the shape rigidity coefficient m is a constant for a given mill with the strips of the same width. The measuring method according to the present invention is therefore divided into two parts for steel strips of the same width. The first part is to determine the shape rigidity coefficient m, and the second part is to calculate the strip crown and the flatness of each pass using the shape rigidity coefficient m and equations (7) and (8).

In the first step, three samples of the same width B are chosen and the entry thickness $H_l$ and entry crown $C_{H_l}$ of sample No. 1 are measured.

In the second step, the schedule for sample No. 1 is worked out according to the known designed mathematical model, including an exit thickness $h_l$, rolling pressure $P_l$ and roll gap $S_l$ which is obtained by using the exit thickness $h_l$ and the rolling pressure $P_l$.

In the third step, a mill to be measured is provided according to the roll gap $S_l$ obtained in the second step and roll diameter 2R thereof is measured.

In the fourth step, sample No. 1 is sent to the mill to undergo only one pass. Actual rolling pressure $P^l{}_l$ is applied during the rolling of sample No. 1.

In the fifth step, exit thickness $h^l{}_l$ and exit crown $C_{h_l}$ are actually measured to calculate the reduction rate $r_l$ using the following equation, $$r_1 = \frac{H_1 - h_1^1}{H_1}$$

and then radius $R^l{}_l$ of roll flattening is calculated by using equation, $$R_1^1 = R\left(1 + \frac{2.14 \times 10^{-4} \cdot P_1^1}{B(H_1 - h_1^1)}\right)$$

In the sixth step, the reduction rate $r_l$ and the radius $R^l{}_l$ of roll flattening are substituted into the following equation to calculate the strip rigidity coefficient $q_l$, $$q_1 = \frac{p_1^1}{B\sqrt{R_1^1(H_1 - h_1^1)}\, r_1}$$

In the seventh step, the above steps (1)–(6) are repeated to measure entry thickness $H_2$, $H_3$, entry crowns $C_{H_2}$, $C_{H_3}$, exit thickness $h_2$, $h_3$, exit crowns $C_{h_2}$, $C_{h_3}$ and strip rigidity coefficients $q_2$, $q_3$ of samples No. 2, No. 3.

In the eighth step, by using the values obtained from steps (1)–(7) and the following equation, heredity coefficients $\eta_1$ and $\eta_2$ are calculated respectively, $$\eta_k = \frac{\partial C_{h_k}}{\partial C_{H_k}} \cdot \frac{H_k}{h_k}$$

where k—No. of samples;

In the ninth step, by using equation (10), $$m_k = \frac{q_k(1 - \eta_k)}{\eta_k}$$

where k—No. of samples; shape rigidity coefficients $m_1$, $m_2$ and $m_3$ of the samples No. 1, 2 and 3 are calculated respectively.

In the tenth step, by using equation, $$m = \sum_{k=1}^{2} \frac{m_k}{2}$$

shape rigidity coefficient m of the mill corresponding to the strip width of B is calculated.

In the eleventh step, real time strip crown and flatness of each pass with the strip width of B can be obtained with much less calculation by means of constant shape rigidity coefficient m obtained in tenth step and equations (7), (8).

It shall be noted that even though only three samples are used in the above description, six or seven samples shall be used in practical application to guarantee accuracy and then work out the shape rigidity coefficient m related to a certain strip width based on the tenth step.

It shall also be noted that a plot of the shape rigidity coefficient m relevant to the strip width B can be depicted when four different shape rigidity coefficients m relevant to four different strip width are obtained for a given mill. With the plot, a shape rigidity coefficient in relevant to a strip of certain width can be found conveniently, when desired.

Furthermore, the measuring steps mentioned above may be achieved through computer rolling simulation.

Compared with the prior measuring method, for a given mill and given strip width, the strip crown and the flatness of each pass can be measured and calculated conveniently in practical production by using the shape rigidity coefficient m which is a constant parameter obtained by calculating only one heredity coefficient $\eta_i$ of any pass in advance. As for the prior technique, the heredity coefficient $\eta$ of each pass has to be calculated individually, which requires tremendous work and large calculation equipment.

By using the measuring method according to the present invention, real time strip crown and flatness of each pass can be obtained, which therefore makes the shape control in rolling more convenient.

When a mill used in iron and steel manufacturing industry is equipped with complete mechanical strip crown control equipment (such as CVC, PC, HC Roll bending device etc.), in which the flatness $\Delta\epsilon$ may reach or approximate zero, the physical characters of the strip shape can be thoroughly expressed using equation (7) only. A comprehensive model for calculating the crown $C_{hn}$ of a finished product can be obtained by using equation (7) to calculate each pass successively. It is expressed in the following mathematical form:

$$C_{h_n} = \frac{\prod_{i=n}^{1} q_i}{\prod_{i=n}^{1} (q_i + m)} \cdot \frac{h_n}{H_1} C_{h_0} + \sum_{j=2}^{n} \frac{\prod_{i=n}^{j-1} q_i}{\prod_{i=n}^{j-1} (q_i + m)} \cdot \frac{m h_n}{H_j} C_{j-1} + \frac{m}{q_n + m} C_n \tag{11}$$

where n—total stand number of the tandem mill or total pass number of the reversible mill;

C—the mechanical strip crown;

i,j—the stand No. of a tandem mill or pass No. of a reversible mill;

$C_{H_o}$—the entry crown;

$C_{h_n}$—the strip crown of finished product.

In the process of rolling, theoretical strip crown $C_{h_n}$ of a finished product is calculated by using model (11) in advance and then actual strip crown $C^l_{h_n}$ of a finished product is measured in practical rolling. Then the $C_{h_n}$ is compared with the $C^l_{h_n}$ and the mechanical crown C of each pass is adjusted respectively based on the difference between $C_{h_n}$ and $C^l_{h_n}$. The above comparison is repeated until $C^l_{h_n}$ approximates $C_{h_n}$. Therefore, self-adaptive control of strip shape is realized.

When a mill without mechanical strip crown control equipment is used and the roll crown and flatness need to be adjusted, the present invention can also be applied even though the flatness $\Delta\epsilon$ does not equal zero. By combining the strip crown $C^l_{h_i}$ and the flatness $\Delta\epsilon_i$ obtained from (7), (8) with a known thickness gauge equation, the following linear equation is obtained:

$$\begin{bmatrix} 1 & 0 & \alpha_i \\ -\frac{\xi_i}{h_i} & 1 & \alpha_2 \\ 0 & 0 & 1 \end{bmatrix} \begin{bmatrix} \Delta C_{h_i} \\ \Delta\Delta\varepsilon_i \\ \Delta h_i \end{bmatrix} = \begin{bmatrix} \left(\frac{q_i}{q_i+m} \cdot \frac{h_i}{h_{i-1}}\right) & \left(-\frac{q_i}{q_i+m} \cdot h_i\right) & \left(\frac{q_i}{q_i+m} \cdot \frac{h_i}{h_{i-1}^2} C_{h_{i-1}}\right) + \frac{mA}{m+q_i} \cdot \frac{h_i}{h_{i-1}} Qi \\ -\frac{\xi_i}{h_{i-1}} & \xi_i & \frac{\xi_i C_{h_{i-1}}}{h_{i-1}^2} \\ 0 & 0 & \frac{-Q_i}{(M+Q_i)} \frac{h_i}{h_{i-1}} \end{bmatrix} \cdot \begin{bmatrix} \Delta C_{h_i-1} \\ \Delta\Delta\varepsilon_{i-1} \\ \Delta h_{i-1} \end{bmatrix} + \begin{bmatrix} 0 & \frac{mA}{m+q_i} \cdot \frac{\partial P}{\partial K} \\ 0 & 0 \\ \frac{M}{M+Q_i} & \frac{\partial P}{\partial K} \Big/ (M+Q_i) \end{bmatrix} \cdot \begin{bmatrix} \Delta S_i \\ \Delta K_i \end{bmatrix} \tag{12}$$

the coefficients in the matrix $$\alpha_1 = \frac{q_i}{(q_i+m)} \cdot \left(\Delta\varepsilon_{i-1} - \frac{C_{h_{i-1}}}{h_{i-1}}\right) + \frac{mA}{m+q_i} \cdot Q_i$$

$$\alpha_2 = \frac{C_{hi}}{h_i^2} \cdot \xi_i$$

where: A—the mechanical strip crown coefficient of roll deformation due to rolling force;

P—rolling pressure;

K—deformation resistance of the rolled piece;

M—longitudinal rigidity of the mill $Q_i$—ductility coefficient of the rolled piece, $$Q_i = \frac{\partial P_i}{\partial h_i};$$

S—the roll gap;

$$\frac{\partial P}{\partial K}$$

partial derivative of deformation resistance, which can be worked out by rolling schedule calculation.

n—total stand number of the tandem mill or total pass number of the reversible mill.

Optimum control of the strip shape and the thickness can be realized by using above mentioned shape and thickness incremental difference equations and the known Bellman dynamic programming method.

Although the invention has been shown and described above, it is obvious for those skilled in the field to make a modification and change without departing from the scope of the claims of the invention.

We claim:

1. A method to measure strip shape in rolling, comprising the following steps:

(1) l samples of the same width B are chosen and entry thickness $H_1$ and entry crown $C_{H_l}$ of sample No. 1 are measured;

(2) the schedule for sample No. 1 is worked out including exit thickness $h_i$, rolling pressure $P_1$ and roll gap which is $S_1$ obtained by using the exit thickness $h_i$ and the rolling pressure $P_1$;

(3) a mill to be measured is provided according to the roll gap $S_1$ obtained in step (2) and roll diameter 2R is measured;

(4) sample No. 1 is sent to the mill to undergo only one pass; actual rolling pressure $P_1$ is applied in the rolling of sample No. 1;

(5) exit thickness $h'_1$ and exit crown $C^l_{h_l}$ are actually measured to calculate reduction rate $r_1$ using the following equation:

$$r_1 = \frac{H_1 - h'_1}{H_1}$$

and then radius $R'_1$ of roll flattening is calculated by using equation:

$$R'_1 = R(1 + \frac{2.14\times 10^{-4}\cdot P'_1}{B(H_1 - h'_1)};$$

(6) the reduction rate $r_1$ and the radius $R'_1$ of roll flattening obtained in step (5) are substituted into the following equation to calculate strip rigidity coefficient $q_l$:

$$q_1 = \frac{p'_1}{B\sqrt{R'_1(H_1 - h'_1)r_1}};$$

(7) steps (1)–(6) are repeated to obtain entry thickness $H_k$, entry crown $C_{H_k}$, exit thickness $h_k$, exit crown $C_{h_k}$ and strip rigidity coefficient $q_k$ of each of samples No. 2-l;

(8) by using the values obtained from steps (1)–(7) and equation, $$\eta_k = \frac{\partial C_{h_k}}{\partial C_{H_k}}\cdot\frac{H_k}{h_k}$$

where k—number of samples the heredity coefficients $\eta_1,\eta_2 \ldots \eta_l$ are calculated;

(9) by using equation, $$m_k = \frac{q_k(1-\eta_k)}{\eta_k}$$

where k—number of samples the shape rigidity coefficients $m_1,m_2 \ldots m_l$ of samples No. 1-l are calculated respectively;

(10) by using equation, $$m = \sum_{k=1}^{l-1}\frac{m_k}{l-1}$$

the shape rigidity coefficient m of the mill with a strip width of B is calculated; and

(11) the strip crown and the flatness of each pass with the strip width of B can be calculated by means of the shape rigidity coefficient m obtained in step (10) and the following equations, $$C_{h_i} = \frac{q_i}{q_i+m}\cdot\frac{h_i}{H_i}C_{h_{i-1}} - \frac{q_i}{q_i+m}\cdot h_i\Delta\varepsilon_{i-1} + \frac{m}{q_i+m}C_i$$

$$\Delta\varepsilon_i = \xi\left(\frac{C_{h_i}}{h_i} - \frac{C_{h_{i-1}}}{h_{i-1}} + \Delta\varepsilon_{i-1}\right)$$

where i—stand number of a tandem mill or pass number of a reversible mill;

ξ—shape disturbing coefficient reflecting the relation between change of the crown ratio and the flatness;

Δϵ—strip flatness; and c—mechanical strip crown.

2. A method as claimed in claim 1, wherein 6–7 samples are adopted.

3. A method as claimed in claim 1, wherein said method further comprises the following steps:

(10') steps (1)–(11) are repeated for three additional sample groups with three different widths, so that four different shape rigidity coefficients m are obtained;

(10") a plot relevant to the shape rigidity coefficient m is depicted using said four shape rigidity coefficients m, whereby a coefficient m relevant to the width of a desired strip to be rolled can be found in the plot.

4. A method to control strip shape in, a tandem rolling mill having a plurality of stands or a reversible rolling mill having a plurality of passes, wherein the mill is provided without shape control equipment, and the flatness Δϵ is zero or approximates zero; said method further comprises the following steps:

(1) by using the measuring method in claim 3, the strip crown of a finished product undergoing the last pass is calculated by $$C_{h_n} = \frac{\prod_{i=n}^{1} q_i}{\prod_{i=n}^{1}(q_i+m)}\cdot\frac{h_n}{H_1}C_{h_n} + \sum_{j=2}^{n}\frac{\prod_{i=n}^{j-1} q_i}{\prod_{i=n}^{j-1}(q_i+m)}\cdot\frac{mh_n}{H_j}C_{j-1} + \frac{m}{q_n+m}C_n$$

where n—total stand number of the tandem mill or total pass number of the reversible mill;

C—mechanical strip crown;

i,j—stand number of the tandem mill or pass number of the reversible mill;

$C_{h_n}$—strip crown of finished product;

(2) in a process of practical rolling, an actual strip crown $C^l_{h_n}$ of a finished product is measured; $C_{h_n}$ is compared with $C^l_{h_n}$ and mechanical strip crown C of each pass is adjusted based on the difference between $C_{h_n}$ and $C^l_{h_n}$; and the comparison is repeated until $C^l_{h_n}$ approximates $C_{h_n}$, whereby strip shape is controlled.

5. A method to control strip shape in a tandem rolling mill having a plurality of stands or a reversible rolling mill having a plurality of passes, wherein the mill is provided without shape control equipment to adjust roll crown, and the flatness Δϵ does not equal zero; said method comprises the following further steps:

(1) strip crown $C_{h_i}$ and flatness $\Delta\epsilon_i$ are obtained using the method in claim 3; and (2) utilizing $C_{h_i}$ and $\Delta\epsilon_i$ to obtain the following linear equation:

$$\begin{bmatrix} 1 & 0 & \alpha_1 \\ -\frac{\xi_i}{h_i} & 1 & \alpha_2 \\ 0 & 0 & 1 \end{bmatrix} \begin{bmatrix} \Delta C_{h_i} \\ \Delta\Delta\varepsilon_i \\ \Delta h_i \end{bmatrix} = \begin{bmatrix} \left(\frac{q_i}{q_i+m}\cdot\frac{h_i}{h_{i-1}}\right) & \left(-\frac{q_i}{q_i+m}\cdot h_i\right) & \left(\frac{-q_i}{q_i+m}\cdot\frac{h_i}{h_{i-1}^2}C_{h_{i-1}}\right)+\frac{mA}{m+q_i}\cdot\frac{h_i}{h_{i-1}}Q_i \\ -\frac{\xi_i}{h_{i-1}} & \xi_i & \frac{\xi_i C_{h_{i-1}}}{h_{i-1}^2} \\ 0 & 0 & \frac{-Q_i}{(M+Q_i)}\frac{h_i}{h_{i-1}} \end{bmatrix}.$$

$$\begin{bmatrix} \Delta C_{h_{i-1}} \\ \Delta\Delta\varepsilon_{i-1} \\ \Delta h_{i-1} \end{bmatrix} + \begin{bmatrix} 0 & \frac{mA}{m+q_i}\cdot\frac{\partial P}{\partial K} \\ 0 & 0 \\ \frac{M}{M+Q_i} & \frac{\partial P}{\partial K}\Big/(M+Q_i) \end{bmatrix}\cdot\begin{bmatrix} \Delta S_i \\ \Delta K_i \end{bmatrix}$$

$$\alpha_1 = \frac{q_i}{(q_i+m)}\cdot\left(\Delta\varepsilon_{i-1} - \frac{C_{h_{i-1}}}{h_{i-1}}\right) + \frac{mA}{m+q_i}\cdot Q_i$$

$$\alpha_2 = \frac{C_{h_i}}{h_i^2}\cdot\xi$$

the coefficients in the matrix are:

where: A—mechanical strip crown coefficient of roll deformation due to rolling force;

P—rolling pressure;

K—deformation resistance of the piece to be rolled;

M—longitudinal rigidity of the mill;

$Q_i$—ductility coefficient of the piece to be rolled, $$Q_i = -\frac{\partial P_i}{\partial h_i};$$

S—roll gap;

$$\frac{\partial P}{\partial K}$$

partial derivative of deformation resistance, which can be worked out by rolling schedule calculation;

n—total stand number of the tandem mill or total pass number of the reversible mill;

optimum control of strip shape and thickness can be realized by using said linear equation.

6. A method to control strip shape in a tandem rolling mill having a plurality of stands or a reversible rolling mill having a plurality of passes, wherein the mill is provided without shape control equipment, the flatness $\Delta\epsilon$ is zero or approximates zero; said method further comprises the following steps:

(1) by using the measuring method in claim 3, the strip crown of a finished product undergoing the last pass is calculated by $$C_{h_n} = \frac{\prod_{i=n}^{1} q_i}{\prod_{i=n}^{1}(q_i+m)}\cdot\frac{h_n}{H_1}C_{h_n} + \sum_{j=2}^{n}\frac{\prod_{i=n}^{j-1} q_i}{\prod_{i=n}^{j-1}(q_i+m)}\cdot\frac{mh_n}{H_j}C_{j-1} + \frac{m}{q_n+m}C_n$$

where n—total stand number of the tandem mill or total pass number of the reversible mill;

C—mechanical strip crown;

i,j—stand number of the tandem mill or pass number of the reversible mill; and $C_{h_n}$—strip crown of finished product;

(2) in a process of practical rolling, an actual strip crown $C^l_{h_n}$ of a finished product is measured; $C_{h_n}$ is compared with $C^l_{h_n}$ and mechanical strip crown C of each pass is adjusted based on the difference between $C_{h_n}$ and $C^l_{h_n}$; and the comparison is repeated until $C^l_{h_n}$ approximates $C_{h_n}$, whereby strip shape is controlled.

7. A method to control strip shape in a tandem rolling mill having a plurality of stands or a reversible rolling mill having a plurality of passes, wherein the mill is provided without shape control equipment to adjust roll crown, and the flatness $\Delta\epsilon$ does not equal zero; said method comprises the following further steps:

(1) strip crown $C_{h_i}$ and flatness $\Delta\epsilon_l$ are obtained using the method in claim 3; and (2) utilizing $C_{h_i}$ and $\Delta\epsilon_i$ to obtain the following linear equation:

$$\begin{bmatrix} 1 & 0 & \alpha_1 \\ -\frac{\xi_i}{h_i} & 1 & \alpha_2 \\ 0 & 0 & 1 \end{bmatrix} \begin{bmatrix} \Delta C_{h_i} \\ \Delta\Delta\varepsilon_i \\ \Delta h_i \end{bmatrix} = \begin{bmatrix} \left(\frac{q_i}{q_i+m}\cdot\frac{h_i}{h_{i-1}}\right) & \left(-\frac{q_i}{q_i+m}\cdot h_i\right) & \left(\frac{-q_i}{q_i+m}\cdot\frac{h_i}{h_{i-1}^2}C_{h_{i-1}}\right)+\frac{mA}{m+q_i}\cdot\frac{h_i}{h_{i-1}}Q_i \\ -\frac{\xi_i}{h_{i-1}} & \xi_i & \frac{\xi_i C_{h_{i-1}}}{h_{i-1}^2} \\ 0 & 0 & \frac{-Q_i}{(M+Q_i)}\frac{h_i}{h_{i-1}} \end{bmatrix}.$$

-continued $$\begin{bmatrix} \Delta C_{h_{i-1}} \\ \Delta\Delta\varepsilon_{i-1} \\ \Delta h_{i-1} \end{bmatrix} + \begin{bmatrix} 0 & \frac{mA}{m+q_i}\cdot\frac{\partial P}{\partial K} \\ 0 & 0 \\ \frac{M}{M+Q_i} & \frac{\partial P}{\partial K}\Big/(M+Q_i) \end{bmatrix} \cdot \begin{bmatrix} \Delta S_i \\ \Delta K_i \end{bmatrix}$$

the coefficients in the matrix are:

$$\alpha_1 = \frac{q_i}{(q_i+m)}\cdot\left(\Delta\varepsilon_{i-1} - \frac{C_{h_{i-1}}}{h_{i-1}}\right) + \frac{mA}{m+q_i}\cdot Q_i$$

$$\alpha_2 = \frac{C_{h_i}}{h_i^2}\cdot\xi$$

where: A—mechanical strip crown coefficient of roll deformation due to rolling force;

P—rolling pressure;

K—deformation resistance of the piece to be rolled;

M—longitudinal rigidity of the mill;

$Q_i$—ductility coefficient of the piece to be rolled, $$Q_i = -\frac{\partial P_i}{\partial h_i};$$

S—roll gap;

$$\frac{\partial P}{\partial K}$$

—partial derivative of deformation resistance, which can be worked out by rolling schedule calculation;

n—total stand number of the tandem mill or total pass number of the reversible mill;

optimum control of strip shape and thickness can be realized by using said linear equation.

8. A method of measuring strip shape in rolling, comprising the following steps:

providing a mill having a plurality of passes;

providing a strip with a width to be rolled;

defining strip shape including strip crown $C_h$ and flatness $\Delta\epsilon$;

defining a shape rigidity coefficient m for the mill regarding the width of strip:

$$m=q(1-\eta)/\eta \quad \text{(A)}$$

where: η—heredity coefficient, and q—strip rigidity coefficient;

determining the heredity coefficient η and the strip rigidity coefficient q for one of the passes;

determining the shape rigidity coefficient m using equation (A);

rolling the strip in the mill; and determining strip crown and flatness of each pass according to following equations:

$$C_{h_i} = \frac{q_i}{q_i+m}\cdot\frac{h_i}{H_i}C_{h_{i-1}} - \frac{q_i}{q_i+m}\cdot h_i\Delta\varepsilon_{i-1} + \frac{m}{q_i+m}C_i$$

$$\Delta\varepsilon_i = \xi\left(\frac{C_{h_i}}{h_i} - \frac{C_{h_{i-1}}}{h_{i-1}} + \Delta\varepsilon_{i-1}\right)$$

where: i—pass number of the mill

ξ—shape disturbing coefficient reflecting the relation between the crown ratio and the flatness;

H—entry thickness;

h—exit thickness; and

C—mechanical strip crown.

9. A method as claimed in claim 8, wherein said method further comprises the following steps:

providing a plurality of additional strips with different widths;

determining a plurality of the shape rigidity coefficients m for the additional strips; and depicting a plot relevant to the shape rigidity coefficients m, whereby a coefficient m relevant to the width of a desired strip to be rolled can be found in the plot.

* * * * *